US008888407B2

(12) United States Patent
Krecke

(10) Patent No.: US 8,888,407 B2
(45) Date of Patent: Nov. 18, 2014

(54) METHOD AND A DEVICE FOR SEALING AND/OR SECURING A BOREHOLE

(76) Inventor: Edmond D. Krecke, Les Floralies (MC)

( * ) Notice: Subject to any disclaimer, the term of this patent is extended or adjusted under 35 U.S.C. 154(b) by 337 days.

(21) Appl. No.: 13/107,039

(22) Filed: May 13, 2011

(65) Prior Publication Data

US 2012/0027519 A1 Feb. 2, 2012

(30) Foreign Application Priority Data

Jun. 21, 2010 (DE) ..... 10 2010 024 496
Jul. 16, 2010 (DE) ..... 10 2010 027 530

(51) Int. Cl.

| | |
|---|---|
| ***E02B 15/08*** | (2006.01) |
| ***B67D 7/78*** | (2010.01) |
| ***E03F 1/00*** | (2006.01) |
| ***E02B 17/00*** | (2006.01) |
| ***E21B 41/00*** | (2006.01) |
| ***E21B 43/01*** | (2006.01) |

(52) U.S. Cl.

CPC ..... *E21B 41/0007* (2013.01); *E21B 43/0122* (2013.01)
USPC ..... 405/64; 405/52; 405/60; 405/65; 405/203; 405/205

(58) Field of Classification Search

USPC ..... 405/52, 60, 63, 64, 65, 203, 205, 210; 114/227, 228; 166/363, 364
See application file for complete search history.

(56) References Cited

U.S. PATENT DOCUMENTS

| | | | | | |
|---|---|---|---|---|---|
| 2,533,697 | A | * | 12/1950 | Stewart | 137/802 |
| 3,516,489 | A | * | 6/1970 | Jergins | 166/353 |
| 3,540,397 | A | * | 11/1970 | Burns | 114/257 |
| 3,642,063 | A | * | 2/1972 | Jergins | 166/353 |
| 3,643,741 | A | * | 2/1972 | Miranda | 166/295 |
| 3,664,136 | A | * | 5/1972 | Laval, Jr. et al. | 405/60 |
| 3,667,605 | A | * | 6/1972 | Zielinski | 210/170.11 |
| 3,681,923 | A | * | 8/1972 | Hyde | 405/60 |
| 3,703,207 | A | * | 11/1972 | Horton | 166/337 |
| 3,719,048 | A | * | 3/1973 | Arne et al. | 405/205 |
| 3,730,267 | A | * | 5/1973 | Scott | 166/335 |
| 3,803,855 | A | * | 4/1974 | Malkiel | 405/210 |
| 4,081,970 | A | * | 4/1978 | Dowse | 405/204 |
| 4,133,761 | A | * | 1/1979 | Posgate | 210/170.09 |
| 4,220,421 | A | * | 9/1980 | Thorne | 405/211 |

(Continued)

FOREIGN PATENT DOCUMENTS

| | | | |
|---|---|---|---|
| DE | 690 06 623 | | 7/1994 |
| EP | 143484 | A1 * | 6/1985 |
| EP | 1067758 | | 1/2001 |
| GB | 2 091 321 | | 7/1982 |

OTHER PUBLICATIONS

Wright, Edward. "The Blockships". May 2, 2009. Link: http://web.archive.org/web/20090502182907/http://www.greatwardifferent.com/Great_War/Naval/Zeebrugge_01.htm.*

(Continued)

*Primary Examiner* — John Kreck
*Assistant Examiner* — Edwin Toledo-Duran
(74) *Attorney, Agent, or Firm* — Pearl Cohen Zedek Latzer Baratz LLP

(57) ABSTRACT

The invention relates to a method and a device for sealing a borehole from which oil discharges uncontrolled. Thereby, a hull is filled with cement and the cement mass is lowered around a cone-shaped pipe so that the cone-shaped pipe is simultaneously fixated and also sealed.

7 Claims, 11 Drawing Sheets

(56) References Cited

U.S. PATENT DOCUMENTS

| | | | | |
|---|---|---|---|---|
| 4,318,442 | A * | 3/1982 | Lunde et al. | 166/357 |
| 4,323,118 | A * | 4/1982 | Bergmann | 166/96.1 |
| 4,343,598 | A * | 8/1982 | Schwing et al. | 417/517 |
| 4,358,218 | A * | 11/1982 | Graham | 405/60 |
| 4,405,258 | A * | 9/1983 | O'Rourke et al. | 405/60 |
| 4,416,565 | A * | 11/1983 | Ostlund | 210/170.11 |
| 4,497,594 | A * | 2/1985 | Fern | 405/217 |
| 4,553,600 | A | 11/1985 | Vigouroux et al. | |
| 4,568,220 | A * | 2/1986 | Hickey | 405/60 |
| 5,024,613 | A * | 6/1991 | Vasconcellos et al. | 604/6.15 |
| 5,224,962 | A * | 7/1993 | Karal et al. | 405/204 |
| 6,592,299 | B1 * | 7/2003 | Becker | 405/210 |
| 7,987,903 | B1 * | 8/2011 | Prado Garcia | 166/75.13 |
| 8,025,103 | B1 * | 9/2011 | Wolinsky | 166/364 |
| 8,322,437 | B2 * | 12/2012 | Brey | 166/363 |
| 2011/0274495 | A1 * | 11/2011 | Estes | 405/63 |
| 2011/0315395 | A1 * | 12/2011 | Wolinsky | 166/363 |
| 2011/0315396 | A1 * | 12/2011 | Wolinsky | 166/363 |
| 2012/0024535 | A1 * | 2/2012 | Lieske, Ii | 166/363 |

OTHER PUBLICATIONS

Coutts, Ashley; Dodgshun, Tim. "The Nature and Extent of Organisms in Vessel Sea-Chests: A Protected Mechanism for Marine Bioinvasions". 2007. Link: http://www.ncbi.nlm.nih.gov/pubmed/17498747.*

Dover-Kent. "Dover in World War I —The Zeebrugge Raid". Feb. 7, 2007. Link: http://web.archive.org/web/20070207225834/http://www.dover-kent.co.uk/history/ww1b_zeebrugge_raid.htm.*

* cited by examiner

METHOD AND A DEVICE FOR SEALING AND/OR SECURING A BOREHOLE

CROSS-REFERENCE TO RELATED APPLICATIONS

This application claims priority from German Patent Application No. 10 2010 024 496.1-24, filed Jun. 21, 2010, and German Patent Application No. 10 2010 027 530.1, filed Jul. 16, 2010, all of which being hereby incorporated by reference in their entirety.

FIELD OF THE INVENTION

The invention relates to a method for sealing and/or securing a borehole under the water surface and a device for closing and/or securing a borehole under a water surface.

BACKGROUND OF THE INVENTION

Reliance on so-called offshore techniques is increasing when extracting natural resources from the earth, and as a consequence, deeper and deeper sources of crude oil are being exploited by deep sea drilling, sometimes at depths far greater than 1,000 m.

In particular, the events on the drilling platform "Deepwater Horizon" have shown that this type of deep sea drilling is connected with high levels of danger and that it is difficult to seal boreholes from which a fluid, in particular, crude oil, discharges uncontrolled. For one, the great depth makes the sealing work generally difficult. For another, the oil often gushes out of the borehole at high pressure, so that it is not even possible to seal the borehole in one step even with a massive dome.

As a rule, known methods for sealing boreholes are, as described, for example, in European patent specification EP 1067758 B1, are designed for sealing ordinarily formed test boreholes and not suitable for sealing a larger hole from which crude oil gushes uncontrolled.

Keeping larger devices on hand with which even large holes can be sealed securely is hardly possible, because of the required size for such, for example, a dome, and would incur immense costs.

OBJECTIVE OF THE INVENTION

The present invention is based on the objective of providing a simple, cost-effective method with which even larger boreholes from which crude oil gushes uncontrolled can be securely sealed or secured.

SUMMARY OF THE INVENTION

The invention is solved already by a method for sealing a borehole under the water surface and by a device for sealing and/or securing a borehole according to one of the independent claims.

For one, the invention relates to a method for sealing and/or securing an opening under the water surface from which fluid gushes uncontrolled, in particular crude oil.

Preferably, the invention is used for sealing and/or securing boreholes in oil production. But an application for other leakages, for example, in oil and gas lines is conceivable. The invention can be used even for gas that is discharging from boreholes, in particular natural gas. Further, even use for prevention, or use in drilling in which the invention can be retrofitted and/or used as equipment and/or complement in new drilling operations. In particular, use in the area of producing gas hydrates is conceivable.

To the extent the term borehole is used in the following for the sake of simplicity, hereby, within the scope of the invention, any opening under the water surface is meant, i.e. also in the form of a defective pipe, etc.

In particular, the method according to the invention is suitable for sealing ordinary boreholes, which are made by an offshore platform for extracting the crude oil from the oil field.

According to the method, first a ship in which a vertical pipe extends through the bottom of the hull is placed above the borehole. Within the scope of the invention, the term ship refers to any floatable body. In particular, floating cranes and platforms, as well as ordinary hulls that include, as a rule, also a keel, can be used. It is also conceivable that the ship consists of a floatable and a non-floatable part. Thus, for example, a non-floatable container can be positioned above the borehole by a catamaran. The ship can also be described as a submersible body.

It is especially provided that older, scrapped hulls are used to reduce costs, as will be explained in more detail in the following.

A vertical pipe extends through the bottom of the ship, or a substantially vertical pipe, or a preferably vertical pipe that is open at the bottom, and which is designed to be placed over the borehole from which crude oil gushes uncontrolled.

Within the scope of the invention, any device that is at least tubular in sections is meant by pipe, for example, also an inverse funnel, a bell-shaped device, etc.

The vertical pipe is a pipe that extends horizontal to the bottom on which the ship is to be placed. The pipe is vertically configured in such a way that, in particular, the oil can be conveyed through the pipe from the bottom to the top. The pipe can also be mounted inclined to the bottom or to the plumb line. In particular, vertical pipe also means a pipe that extends from the underside of the ship through the hull to the upper side of the ship, for example from the keel to the deck.

The ship or a part of the ship is filled with a hardenable mass. In particular, it is provided that the ship is filled with liquid cement. Preferably, fibers or wires have been added to this cement for reinforcement.

In an alternative embodiment of the method, it is also conceivable that the ship is first filled with a dry mass, for example, dry cement and a cement-water mixture is prepared in the hull on location, for example, by introducing sea water. This design variant has the advantage that here, no additional ships must be provided for filling the liquid cement mass.

On the other hand, for this, mixing devices such as, for example, stirrers must, as a rule, be available in the hull, in order to create a sufficiently homogeneous mass.

The ship, or the detachable part of the ship, is submerged above the borehole in such a way that the vertical pipe sits on the borehole. To do so, the vertical pipe preferably includes a cone in the lower section, through which the diameter of the pipe is enlarged in the lower section, so that even larger boreholes are covered. The sinking can, as it is provided in one embodiment of the invention, simply occur thereby, that the ship is loaded with the hardenable mass in such a way, that it no longer has sufficient floatation.

But it is also conceivable that the ship is sunk otherwise, for example, by a number of buoys.

Then the hardenable mass is distributed around the pipe.

The invention is based on the knowledge that in this manner, in a very easy way, an enormous amount of a hardenable mass with great weight and volume surrounds the pipe. As a result of the preferably cone-shaped design and, as it is provided in a further embodiment of the invention, a collar, the hardenable mass engages in a secure, form-fitting connection with the pipe when hardening.

Simultaneously, depending on the ground soil, a hardenable mass such as cement also connects with the ground, so that the pipe, in addition to the mere weight, is additionally connected by material engagement and/or form-fit with the ground.

The invention is further based on the knowledge that only after partial hardening of the hardenable mass, in particular, the cement, the pipe can be sealed and/or secured and now also withstands the enormous pressure of the crude oil.

Inter alia, the invention is also based on the knowledge that sealing the pipe or opening it is not even possible in many cases, as the pressure is so high that a channel immediately forms in the sea bottom, for example, which also flows around a larger sealing device.

In particular, in the case of higher levels of pressures, sealing can therefore be dispensed with and the method according to the invention can be used to channel the discharging fluid.

Thus, within the scope of the invention, the term "securing" also means, in particular, channeling the fluid.

To do so, a directional control valve can be used, for example, in which after the pipe has been put on, the fluid can at first continue to discharge. At a connection of the directional valve that has been established first, a pipeline to pump off the fluid can then be connected. This is easily possible, because no fluid is discharged yet from the connection of the directional valve. Then the directional valve can be switched so that the fluid now discharges from the connection that is connected with the pipeline for extraction.

The opening from which the fluid is discharging can thus be secured without having to seal the stream of fluid. This also makes it possible to secure openings having high pressure.

Preferably, the sealing occurs slowly by using a metering valve so that no sudden peaks of force occur. Thereby, this can, for example, be a slider, a throttling valve or the like. Further, the device can be provided with additional safety units such as, for example, blow-out preventers, attachable riser pipes for discharging the fluid, etc.

After sealing the pipe by using a valve, an extraction hose can be connected to the upper end of the pipe and then by opening the valve, the crude oil can be removed at least partially controlled.

In one embodiment of the invention, the hardenable mass is lowered by a frame that is to be opened or is removable, which surrounds the vertical pipe.

For example, it is provided that a hull is cut open on the bottom and that a frame is inserted in the hull that seals the hull in floating state.

After submerging the ship, the frame can, for example, be opened by a sliding mechanism or removed, so that the hardenable mass discharges from the hull around the pipe.

The hull can, as it is provided in one embodiment of the invention, be lowered, for example, on feet that are at such a height that the hardenable mass discharges from the hull almost completely. In this embodiment of the invention, the hull could be pulled up again and reused. To do so, the pipe would have to be detachable from the hull.

In an alternative embodiment of the invention, the hull can also attach to the hardenable mass and thus represent an additional weight that contributes to sealing the borehole.

Preferably, the ship is submerged by using cables to prevent it from taking on a lateral position. In a preferred embodiment of the invention, the ship includes laterally mounted feet at which, as it is provided in an additional embodiment of the invention, a carrier is mounted at which the cables can be fastened.

To the extent this construction is attached to the outside of the ship, an old ship can be retrofitted in a very easy way into a device according to the invention for sealing a borehole.

The invention further concerns a device for sealing a borehole from which fluid discharges uncontrolled, in particular crude oil. The device consists of a hull that can be filled with a hardenable mass, has a pipe that penetrates the bottom vertically and has means so that the hardenable mass can discharge around the pipe.

The bottom of the hull is preferably open around the pipe and a frame is located around the pipe which seals the floating hull. After lowering the ship, this frame can be opened or—as it is provided in a further embodiment of the invention—be used as shaping element for the hardenable mass, so that it does not form a thin layer in an area that is too wide.

For this, as it is provided in a further embodiment of the invention, the frame can also be lowered downward out of the hull.

In a further development of the invention, the pipe is heatable. By heating the pipe, in particular when using the device at very great depths it is prevented that the discharging oil solidifies in the pipe after a short time, which can cause that oil, which is streaming in builds up at such a high level of pressure that the pipe is pushed away before the hardenable mass has hardened.

By using a hull, large amounts of hardenable mass can be applied directly at the borehole. In particular, it is provided that a hull is filled with at least 2,000, preferably at least 4,000 $m^3$ hardenable mass.

In order to reach sufficient floatation even at large volumes for transporting the hardenable mass, the ship can be provided with buoys. Alternatively or additionally, a hardenable mass can be used that has a density that approximately corresponds to the density of water. Preferably, the density is in a range of approximately 0.8 $g/cm^3$ to approximately 1.2 $g/cm^3$. In particular, light-weight concrete can be used. In one embodiment, a hardenable mass is used having a density in the range of 0.6 $g/cm^3$ to 2.4 $g/cm^3$.

Preferably, the pipe has a diameter of at least 1 m at the lower end, preferably at least 3 m. The opening in the bottom of the ship, also described as frame, preferably has a diameter of at least 5 m.

As an alternative or complement to the fastening according to the invention cited above, by using the hardenable mass, the fastening occurs by means of a type of suction or adherence to a bottom, here the seafloor.

Further, the invention relates alternatively or complementary to the use of a suction box, which is provided in particular for use as suction dome for sealing an opening in a previously described method. The suction box is a submersible body or comprises a submersible body.

In one embodiment, the suction box thus comprises several, i.e. at least two separate compartments, whereby one compartment is designed for extracting a fluid, and whereby an additional compartment is designed open downward. The unit described here as suction box represents a system, which has at least one construction for fastening and/or bearing pipe 4, and a unit for fastening on the seafloor.

In contrast to known domes that are used, for example, for extracting crude oil, a second and/or the additional compartment that is not used for extraction or sealing the borehole, is substantially used only for fastening.

In a preferred embodiment of the invention this is performed thereby, that the additional compartment can be evacuated within its surroundings. In particular, the additional compartment is evacuated by pumping off the water that is contained in it. Because for submersion, the inner compartment can, for example, contain water or be filled with water.

Thus, it is provided, for example, to provide the suction box with pumps that are used to evacuate the compartments which are for the purpose of fastening and which are preferably located around a centrally located compartment for extracting the fluid, and can thus adhere to the ground. It is understood that within the scope of the invention, this does not mean the complete removal of a fluid from the compartments, but only the generation of an underpressure with respect to the surrounding environment.

The pumps for evacuation are preferably mounted on the suction box itself. But at lower depth it is also conceivable to evacuate the compartments by using a pipe.

In one further development of the invention, the suction box comprises at least an anchor. In particular, it is provided that the suction box has a number of anchors at the edge, using which the suction box can likewise be secured on the bottom.

The suction box is used primarily for sealing leaks of boreholes or pipelines in deep sea. But a use in flat water is also conceivable.

Further, use for prevention in drilling operations is also conceivable where the suction box can be retrofitted, or be part of the equipment or complement of such for new boreholes. In particular, application in the area of extraction of gas hydrates is conceivable.

The basic principle of the suction box is similar in function to the previously described method for sealing openings.

First, a container, which is open downward and is additionally open upward, but which can be closed is used to channel the fluid stream of a leak.

In a next step, this container is connected firmly and imperviously with the seafloor.

This can be done, for example, by the previously described evacuation of compartments and/or by the previously described hardenable mass.

The suction box or suction container can also represent an additional safety system, for example, in off-shore drilling, as the box forms a protective casing around the pipe or the borehole.

Thereby, the suction box can include compartments and/or openings through which drilling equipment can be guided. For example, this can be a drill or also equipment such as a blow-out preventer or a riser pipe. Should the standard system that is present fail, the upper exit of the box can be closed, for example, by a slider, by a valve or by a blow-out preventer.

Further, the invention is suitable especially for achieving a controllable extraction of gas hydrates. In the perimeter of the container, the sea bottom can be sealed with concrete in order to stabilize it. Thereby, geotextiles can be used.

The invention further relates to a method for sealing an opening under the water surface. Thereby, a device that includes a pipe for extracting a fluid is lowered to the seafloor whereby the device includes at least one container that is open downward but closed upward.

Then the container that is open downward is evacuated within the surrounding environment, so that it adheres to the seafloor. After the device has been fastened, the pipe can be sealed and a pipe for extracting the fluid can be attached.

It is also conceivable that the device according to the invention is designed modular. For example, modules which are designed as suction dome for adhering to the sea bottom can be provided to which additional equipment can be attached and which thus serve to fasten such equipment.

DETAILED DESCRIPTION

Figure 1:
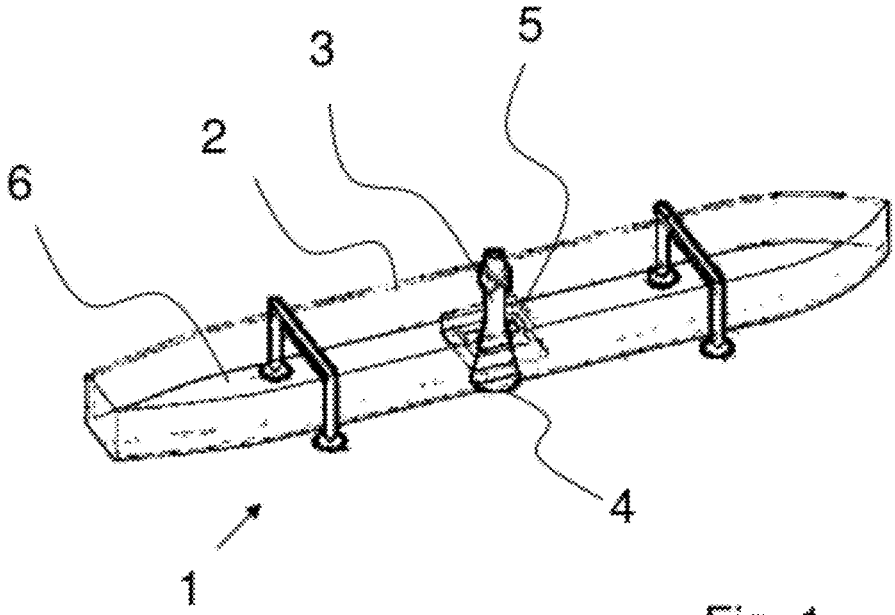
FIG. 1 shows the device for sealing a borehole 1 with its important components in a schematic illustration.

In the following, the invention will be explained in more detail by referring to the drawings in FIG. 1 to FIG. 4, with the help of a schematically illustrated exemplary embodiment.

The drawings show a device for sealing a borehole 1 in various operating states.

FIG. 1 shows the device for sealing a borehole 1 with its important components in a schematic illustration. The device for sealing a borehole 1 includes a hull 2, which—as is not shown here—can preferably be designed closed on the top as well.

In hull 2, a hardenable mass, in particular cement, can be housed in large amounts. The bottom of the hull 6 includes a cut-out into which a frame 5 is inserted.

Approximately in the center of this cut-out, a pipe 3 is located, which has an open cone located downward. The fastening of the pipe on the hull planking is not shown in further detail in this exemplary embodiment.

Figure 2:
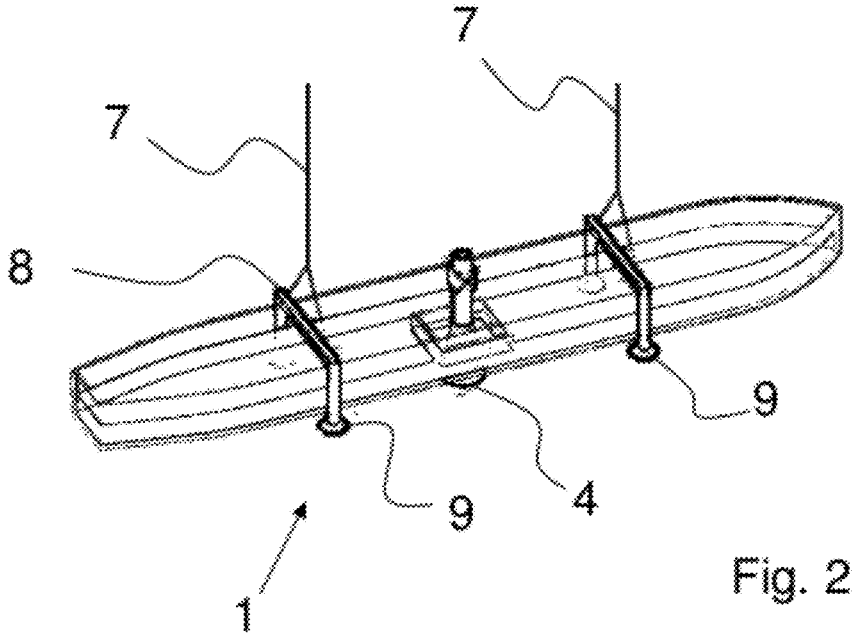
FIG. 2 shows the device for sealing a borehole.

After filling the hull, the device for sealing a borehole is lowered by cables 7 as shown in FIG. 2.

To stabilize the device for sealing a borehole 1 during lowering, cables 7 are fastened at a carrier which is mounted on the outside of the hull and which simultaneously serves to house four feet 9.

The device is lowered in such a way that cone 4 is located above the borehole.

Feet 9 ensure that the hull is aligned above the borehole.

For using the device in uneven terrain it is conceivable to also equip the device with adjustable feet.

Figure 3:
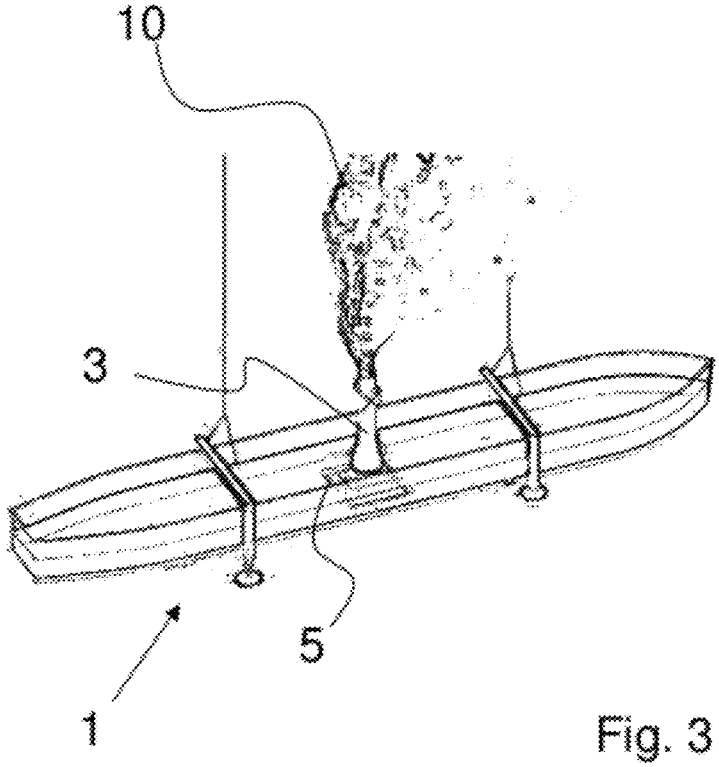
FIG. 3 shows how the fluid crude oil discharges from a pipe.

FIG. 3 now shows how the fluid crude oil 10 discharges from pipe 3. The device for sealing a borehole 1 sits on the seafloor with its feet (not shown).

Figure 4:
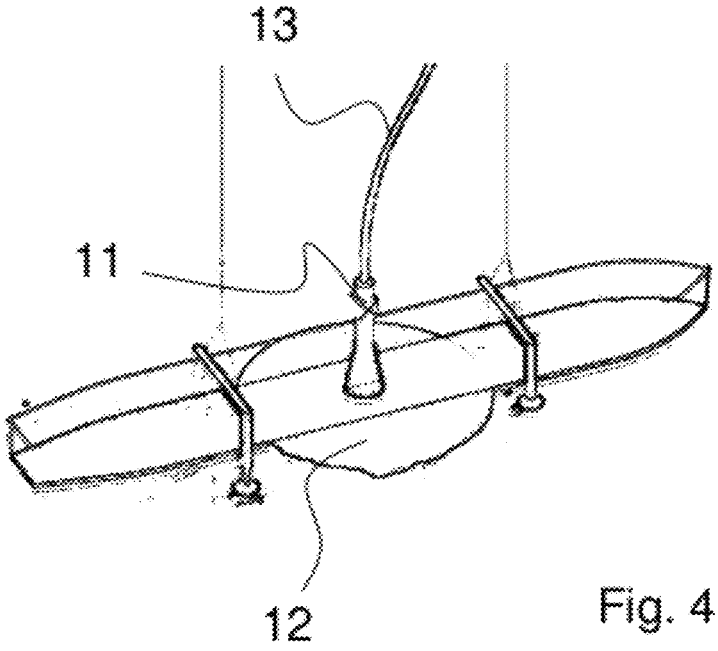
FIG. 4 shows the device.

Frame 5 is now opened or lowered down, so that the reinforced cement present in the hull can leak out next to pipe 3. Then, as shown in FIG. 4, cement 12 must be hardened, as a result of which the pipe is securely fixated on the borehole.

Thereupon, the discharging oil can slowly be stopped by using a throttling valve 11, and a pipeline 13 can be connected to the pipe.

By renewed opening of valve 11, the crude oil can now be extracted.

As an alternative or complement to the fastening cited above according to the invention using the hardenable mass, the fastening is performed by a type of suction or adhesion to the seafloor.

Figure 5:
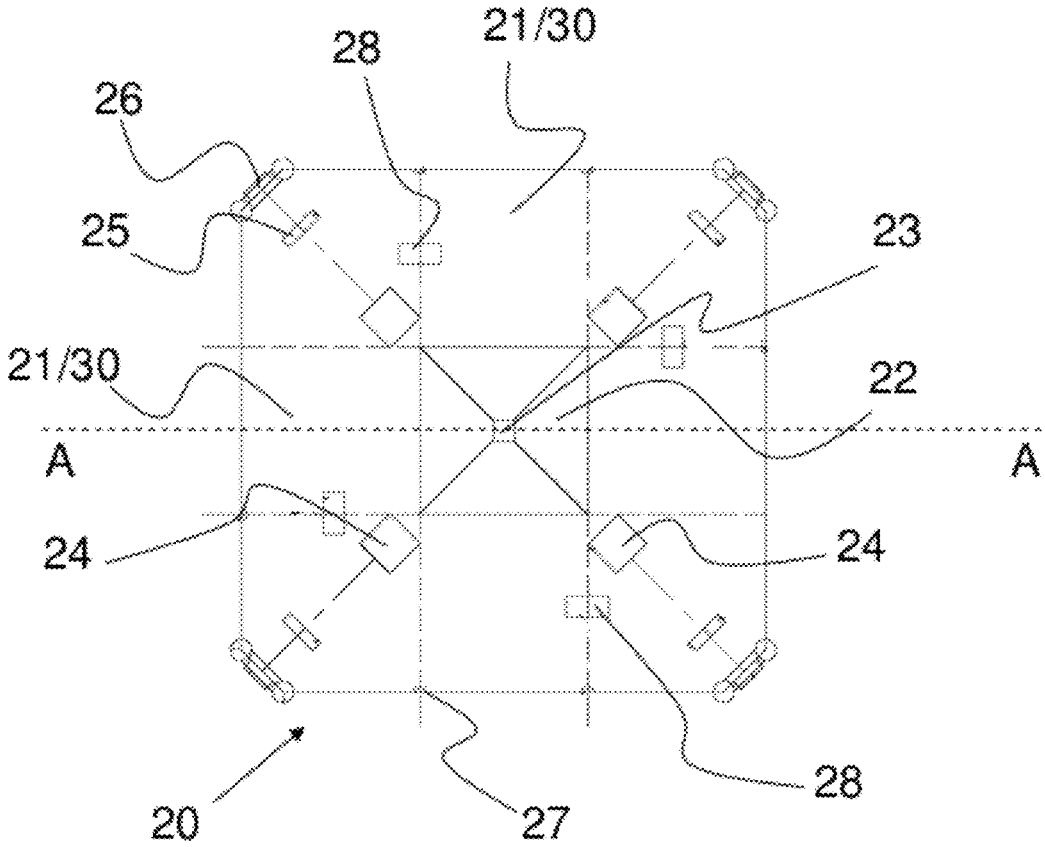
FIG. 5 shows a suction box or a submersible body.

FIG. 5 shows suction box 20 or a submersible body according to the invention with an extraction device 3 according to the invention in a top view.

Suction box 20 includes a number of compartments, whereby here by way of example, eight outer compartments 21 are located around a centrally located inner compartment 22.

Figure 6:
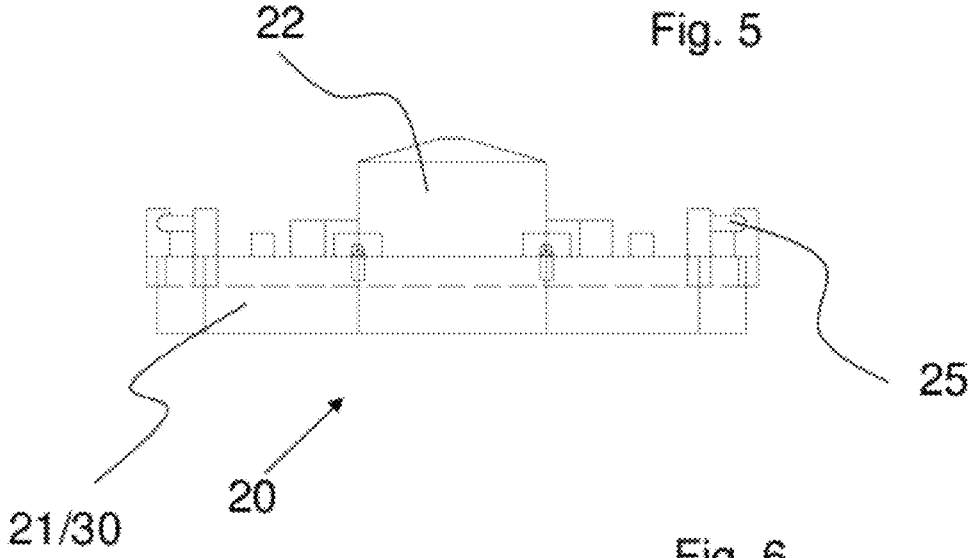
FIG. 6 shows the entire suction box from FIG. 5 in cross section.

FIG. 6 shows the entire suction box 20 from FIG. 5 in cross section along axis A-A. It can be seen that the inner compartment 22, in which pipe 3 is located or affixed, is designed dome-shaped or dome-like.

Preferably, inner compartment 22 is higher than outer compartment 21.

Inner compartment 22 is open on the top and includes an extraction opening 23 for extracting the fluid. Inner compartment 22 includes pipe 3 according to the invention for extracting the oil (concerning this see also FIGS. 7 and 8).

Compartments 21 represent the actual suction boxes or units for fastening or adhesion 30. They are closed on the top and open on the bottom and can be evacuated by pumps 28 within the surrounding environment. Thereby, a difference in pressure with respect to the surrounding environment is generated to that compartments 21 are sucked onto seafloor 40 and are consequently fastened. As compartments 21 are connected with inner compartments 22, thus pipe 3 that is located in inner compartment 22 is also fastened on seafloor 40.

Suction box 20 can, for example, have dimensions of approximately 25 m×25 m. The outer compartments 21 can at first contain water or be filled in order to submerge it and thereby the entire unit 20. The outer compartments 21 are evacuated when the suction box has reached the seafloor, and they thus firmly adhere to floor 40.

Because of the great weight, suction box 20 presses into seafloor 40 so that as a rule, all outer compartments 21 are sufficiently sealed.

As a result of evacuating compartments 21, in particular at great depth, a very large force and a very high level of pressure can be exerted on the lower edges of the construction.

For additional fastening and/or for positioning, suction box 20 in particular also includes ship 2 and/or all other embodiments according to the invention, further anchors 26 located at the edge, which are connected with winches by a steel wire rope (not shown), which runs over guide pulley 25.

This is how the anchors can be lowered and suction box 20, in particular also ship 2, and/or all other embodiments according to the invention can be positioned by using winches 24 and fastened.

Suction box 20 further includes, in particular also ship 2 and/or all other embodiments according to the invention, eyes 21 located at the edges, in particular for lowering it.

Positioning of a suction box 20, in particular also ship 2 and/or the other embodiments according to the invention can, for example, especially at low current, or if the depth position under water permits, take place by using underwater tug boats such as robotic vessels or U boats. Use of underwater tug boats, robotic vessels and/or U boats preferably takes place at great depths. Preferably or additionally, by using cables at which suction box 20 hangs, positioning is performed from the top.

It is a further possibility, for example, to position suction box 20, in particular also boat 2 and/or all other embodiments according to the invention, preferably exclusively by anchors 26, which are lowered prior to lowering suction box 20, via deflection pulleys In FIGS. 5 and 6, inner compartment 22 and outer compartments 21 that cause the actual adhesion and thus ensure anchoring on the seafloor, are connected with each other. They form one unit or unit 20, which is described as suction box 20.

Figure 7:
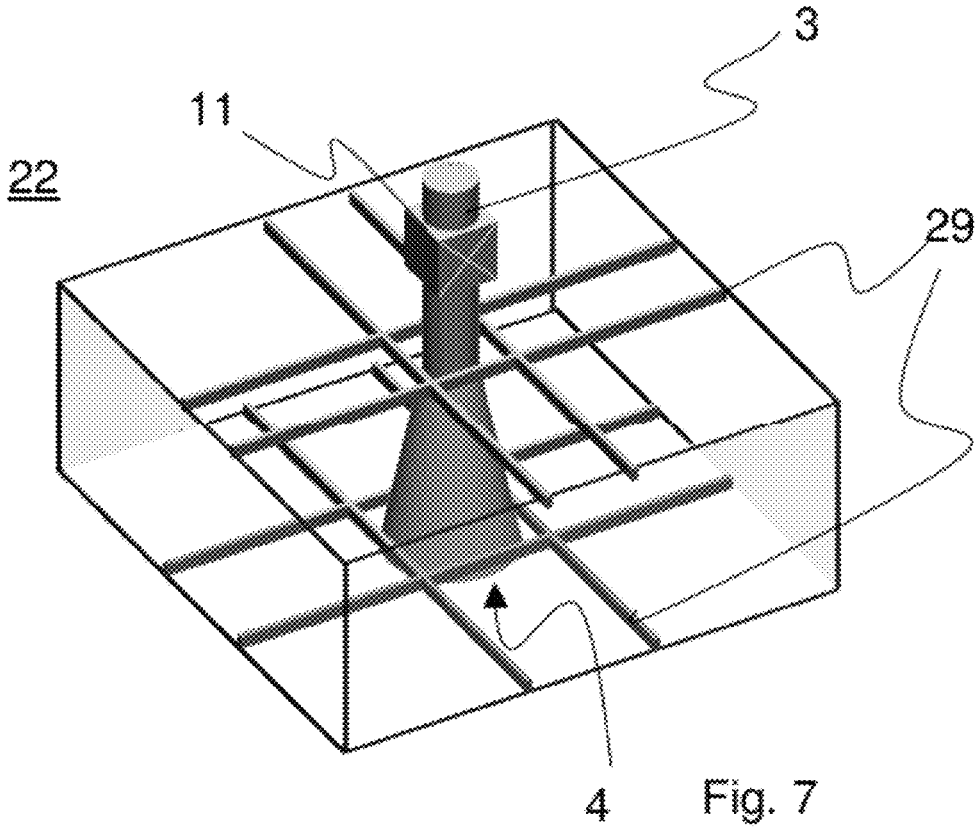
FIGS. 7 and 8 show a spatial detail view of inner compartment from FIG. 5 in a lateral top view (FIG. 7) and in a lateral view of the underside (FIG. 8).
Figure 8:
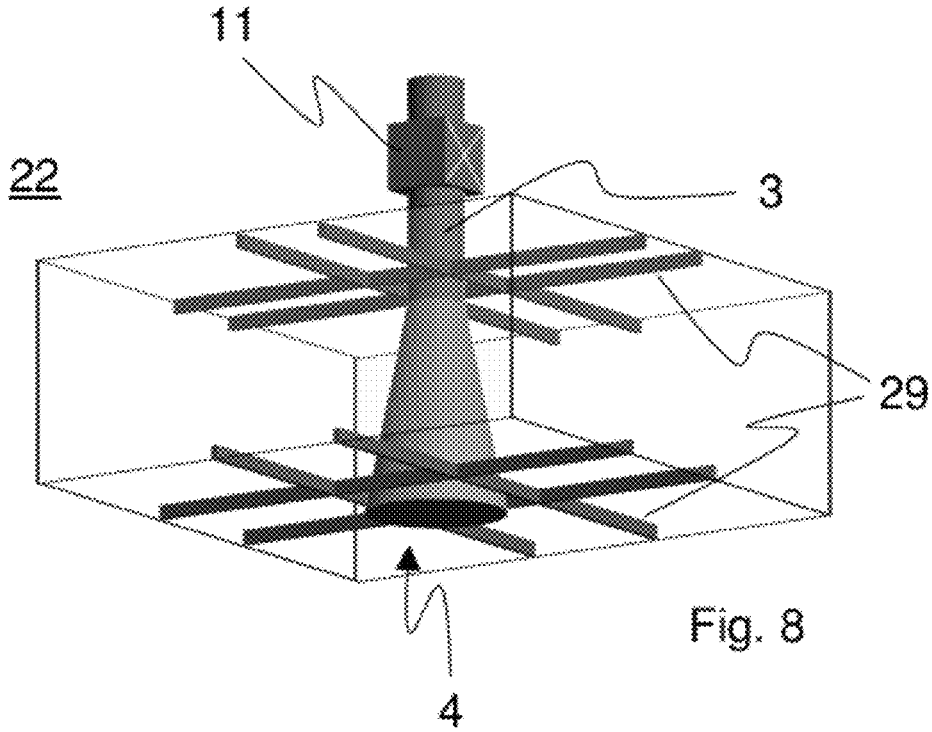

FIGS. 7 and 8 show a spatial detail view of inner compartment 22 from FIG. 5 in a lateral top view (FIG. 7) and in a lateral view of the underside (FIG. 8). The entire suction box 20 from FIG. 5 is shown without outer compartments 21 and thus without the actual suction or fastening devices. Shown is suction device 3 according to the invention or pipe 3 according to the invention together with a type of carrier and/or fastening construction. Funnel-shaped or funnel-like pipe 3 is located in the center. In the illustrated design it has a larger opening on the underside compared to the opening on the upper side. To exemplify, a type of funnel 3 is formed. The cone has a diameter of approximately 2 m to 5 m. In an embodiment that is not shown, pipe 3 can also be cylindrical. Pipe 3 or funnel 3 is substantially located in the middle or in the center of inner compartment 22 and/or unit 20. Pipe 3 should preferably project at least 3 m to 4 m under frame 29 of inner compartment 22 and/or unit 20, and in particularly protrude.

The carrier construction and/or fastening construction for pipe 3 is formed by carrier 29, or it includes carrier 29 or frame 29. Preferably, it is a steel plate frame. However, other materials with comparable properties can also be used. Frame 29 or carrier 29 has, for example, a diameter or a wall thickness of 10 mm to 30 mm, preferably of approximately 20 mm. The edge length of inner compartment 22 is approximately 20 m to 25 m here. Carriers 29 can form a reinforcement or stiffening for inner compartment 22. Carriers 29 form a type of grid or grid construction and/or box, in particular for pipe 3. Carriers 29 are located by way of example on the top and on the bottom or in the area of the upper side and the lower side of inner compartment 22. Carriers 29 partially extend horizontal to each other. For example, the mesh of this grid is selected here to be rectangular so that carriers 29 extend parallel or rectangular to each other. The mesh or the two meshes of the grid through which pipe 3 extends are designed in such a way here that the upper mesh has a larger cross section than the lower mesh. Thereby, inter alia, funnel-shaped pipe 3 can be fastened effectively.

Figure 9:
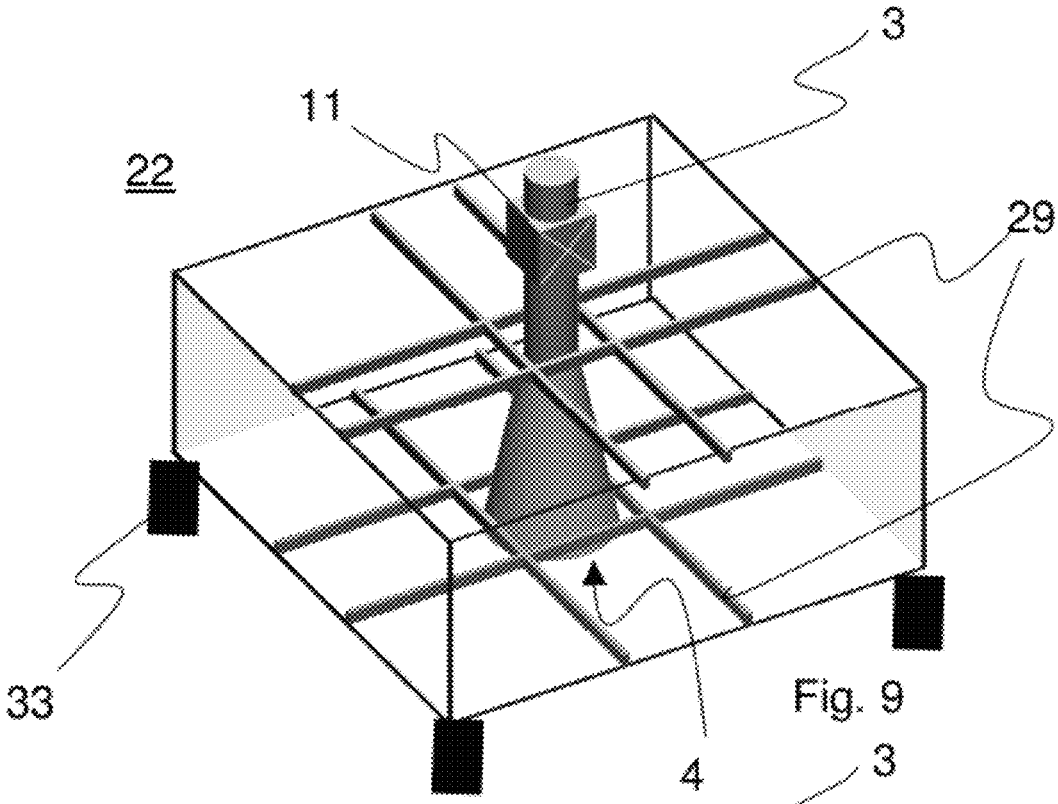
FIGS. 9 and 10 show the system 22 from FIG. 7 with respectively attached feet or stilts 33.
Figure 10:
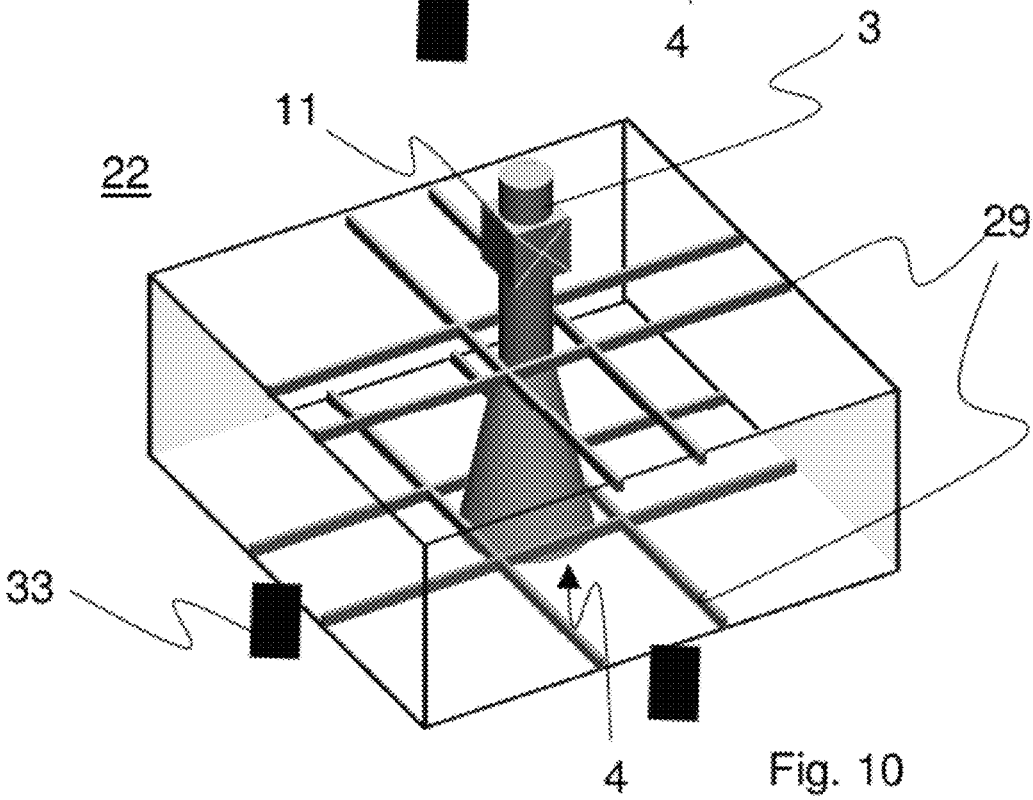

System 22 from FIG. 7 is shown in FIGS. 9 and 10 with respectively attached feet 33 or stilts 33. Respectively four stilts 33 are attached, of which, however, only three stilts 33 are visible in FIG. 9 and two stilts 33 in FIG. 10. In the embodiment shown in FIG. 9, stilts 33 are respectively located at the corners of square 22.

In the embodiment according to FIG. 10, stilts 33 are located essentially in the center at the edge lengths of square 22. Preferably, stilts 33 can be adjusted in height. Thus, for example, uneven ground on which construction 20 or 22 is to rest can be adjusted. Stilts 33 can be adjusted in height in a range of approximately 2 m to 4 m.

The configurations shown in FIGS. 7 to 10 (and/or the configurations shown in FIGS. 13 to 16) have a modular character. They can be used manifold, in particular in connection with additional construction components. Concerning this, FIGS. 11 and 12 show use with a suction box 30 (FIG. 11) and with a so-called extraction pipe 32 (FIG. 12).

Figure 11:
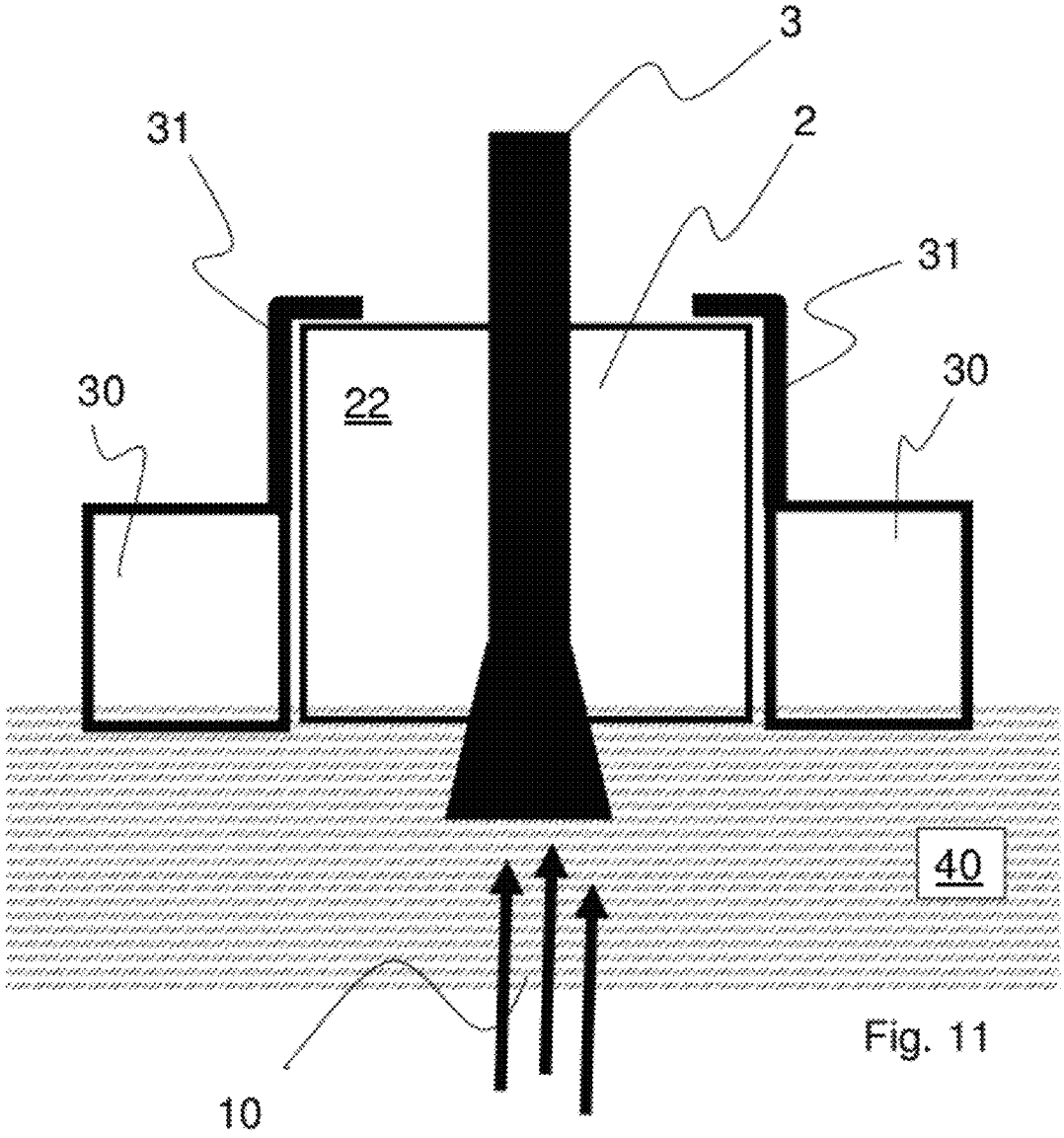
FIG. 11 shows the configuration shown in FIGS. 7 and 8 in a simplified illustration in cross section.

Further, FIG. 11 shows the configuration shown in FIGS. 7 and 8 in a simplified illustration in cross section. At inner compartment 22, or at the carrier construction and/or fastening construction for extraction pipe 3, two suction boxes 30 are located or mounted. Suction boxes 30 are connected by fastening means 31 with carriers 29 by carrier construction and/or fastening construction. By evacuating chambers 30, these are sucked onto seafloor 40 and thus fastened to it. Pipe 4 abuts at least with its open underside on seafloor 40. If the suction pressure is selected to be sufficiently large, the extraction pipe, as schematically shown, can even penetrate the floor. As a result, a type of first sealing is provided for pipe 4. In particular, in connection with hardenable mass 12, such as, for example cement, the seal effect can be increased or improved. Thereby, pipe 3 is securely fastened above a leak and sealed, so that discharging oil 10 can be captured.

Figure 12:
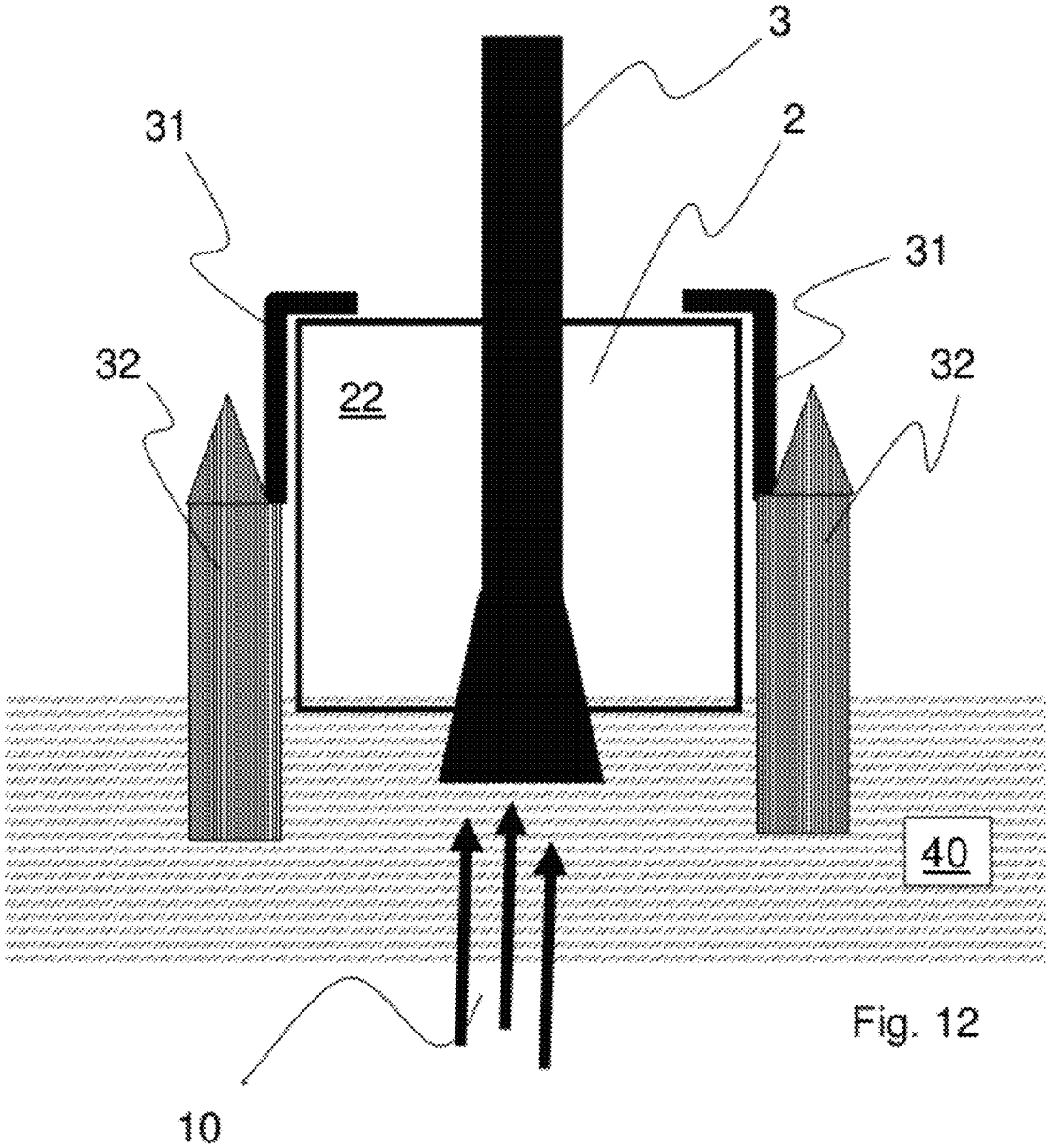
FIG. 12 shows the configuration from FIG. 9.

FIG. 12 shows the configuration from FIG. 9. In place of suction boxes 30, now extraction pipes 32 are used. They are essentially closed on the upper side. There, they have only an exit opening to which an extraction pipe is connected. The diameter of the opening at the underside can be in a range of dimensions of dm to m. By evacuation or suction, extraction pipes 32 are sucked onto the seafloor and even drilled into it, so that a safe fastening or anchoring of pipe 3 can be ensured.

Figure 13:
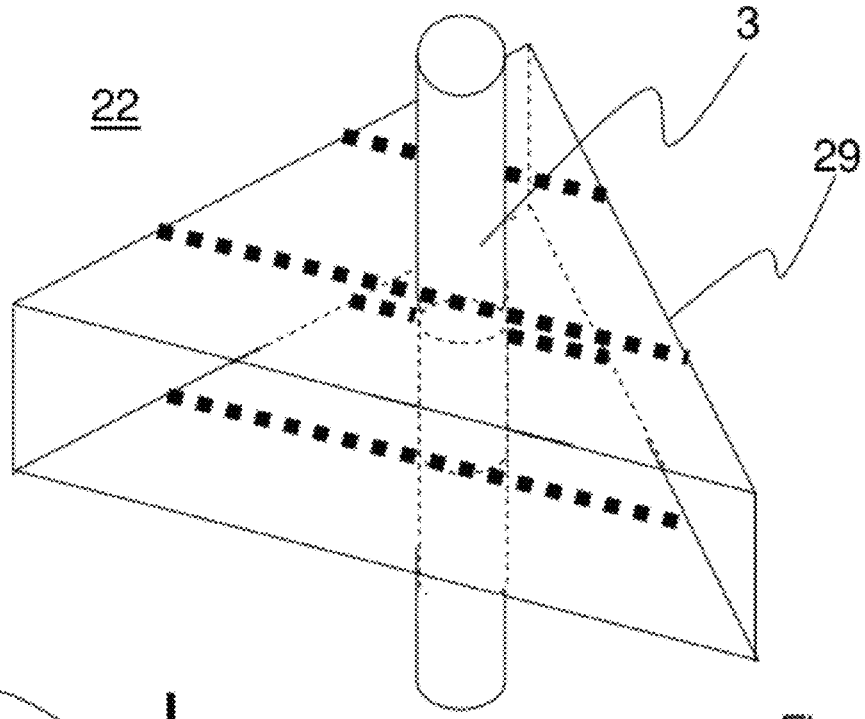
FIGS. 13 and 14 show a further embodiment.
Figure 14:
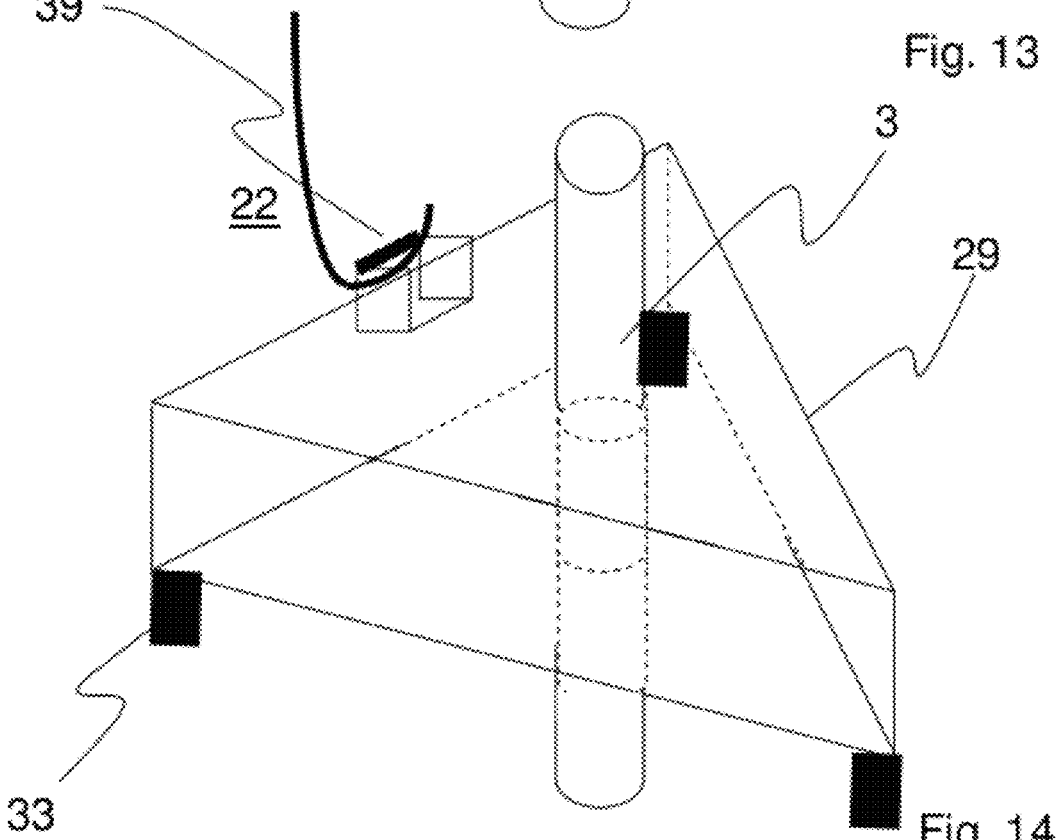

The square configuration or frame construction 22 shown in FIGS. 7 and 8 can be designed in a further embodiment shown in FIGS. 13 and 14, also as preferably equilateral triangle. In contrast to a square, a triangle permits simplified justification on one level. Thereby, frame construction 22 can be a component of unit 20. But it can also be provided as such and thus be provided by itself in order to be positioned on a borehole. The features cited above for the square can also be combined with the features that will be mentioned in the following concerning the triangle.

Preferably, the edge lengths of the triangle are likewise in the range of approximately 20 m to 25 m. Depending on size and material selection of frame construction 22, reinforcement with a cross beam is possible or even necessary. Pipe 3, preferably positioned or attached in the center can be designed as cylindrical riser pipe and thus without a cone.

The diameter of pipe 3 is approximately 2 m to 5 m. Cylinder 3 preferably projects approximately 3 m to 4 m under the frame or frame construction 29, so that it can put itself—with frame weight and pipe weight—over an existing or a future borehole.

In a preferred embodiment, pipe 3 narrows within the height of frame 29 in such a way that toward the top, a possibility of connecting a valve, for example, a three-way valve 11 with a diameter of, for example, 30 cm, as well as for coupling riser pipe 37 is given. Beyond that, the narrowing of pipe 3 within the height of frame 29 can connect the narrowed pipe to a greater degree with the concrete to the borehole actuated by gravity.

In a further preferred embodiment, vertical ribs 38 are located on pipe 3—within the height of frame 29—which prevent a rotation of the concrete mantle with respect to pipe 3, and thereby further improve the composite of concrete and pipe.

Preferably, height-adjustable stilts 33 are also attached to the triangle per corner or edge that can, in particular, be adjusted in height by approximately 2 m to 4 m (concerning this see FIG. 14). As a result it can be made possible that the concrete flows not only around cylinder 3, but that it also flows through under frame 29. The flow can, in particular, occur up to a diameter of 20 m to 50 m, to make the formation of concrete slab 34 possible, here under frame 29. Concrete slab 34 can have a height of approximately 2 m to 4 m. It will, by means of its weight and its strength, connect and seal rising pipe 3 with the borehole, actuated by gravity and/or by material engagement, and on seafloor 40 provide protection against oil and/or gas leaks with this large concrete diameter.

Figure 15:
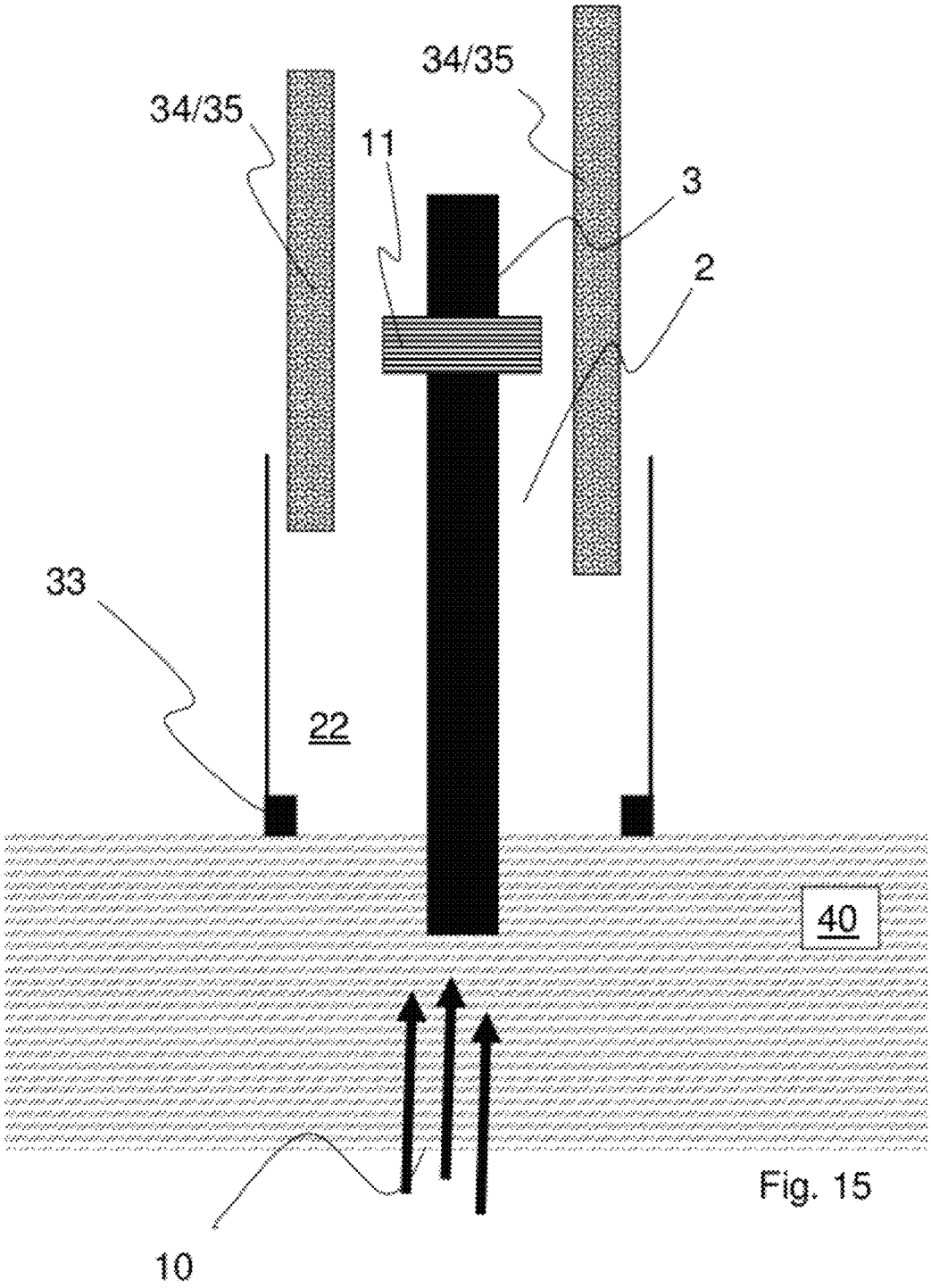
FIGS. 15, 16 and 17 exemplify a method.
Figure 16:
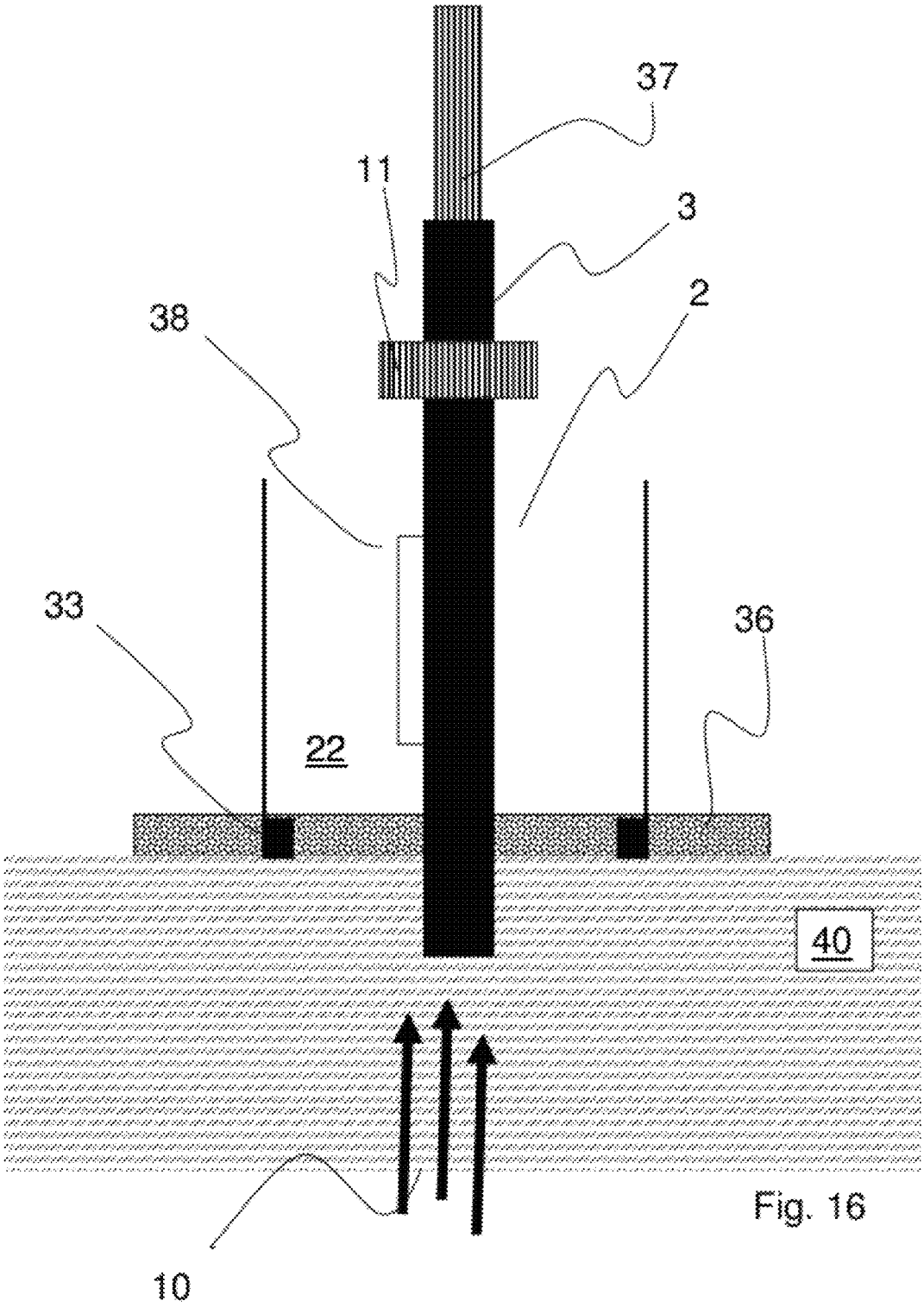

The method is exemplified in FIGS. 15 and 16 in sections.

After placing frame 22 with cylinder 3 on an existing borehole or on a future borehole—from the top—for example, by working ships, subject to gravity by, in particular 2 to 3 lines 34 or hose lines 34, concrete 35 or a hardenable mass 35 is filled into frame 22 and/or through frame 22 underneath. This mass 35 is generally filled up to a necessary diameter and a required strength. In particular, concrete 35 is a fresh, quickly hardening and/or fiber-reinforced concrete 35. Preferably, concrete 35 has a weight class starting at or larger than 1,400 kg/m$^3$.

This connection actuated by gravity or by material engagement between cylindrical riser pipe 3, borehole and seafloor 40 makes forming a concrete slab 36 possible by the hardening of concrete 35 after a few days. Three-way valve 11, which is attached to the head, guides the oil briefly through a rotation, for example, a 90° rotation of valve 11, laterally into the sea again. Thereby, it is made possible that to the extent it has not already been installed in advance, oil riser pipelines 37 can be installed above three-way valve 11. After installation of these riser pipelines 37 to oil tankers or the like has been completed, which can also occur for a short time, three-way valve 11 is again opened toward the top, for example, by a rotation of 90°, so that the oil stream flows to the top under its own pressure and/or is pumped. In the meantime, concrete slab 36 has reached a strength and density to prevent a leakage of oil and/or also gas.

This "triangular frame" 22 with centered cylinder 3 in the middle and three adjustable feet 33 at the frame of 2-4 m length is the most economical and fastest possibility of sealing or securing collapsed, existing or future boreholes for oil and/or gas. The height of triangular frame 22 should be between 2 and 5 m.

To detach the devices brought into position on the seafloor from the working ship, retaining devices 39 can be attached, for example, at the three or four edges of the devices, which release the cables and thus decouple from the devices, so that they are released for retrieval and can be used again.

Figure 17:
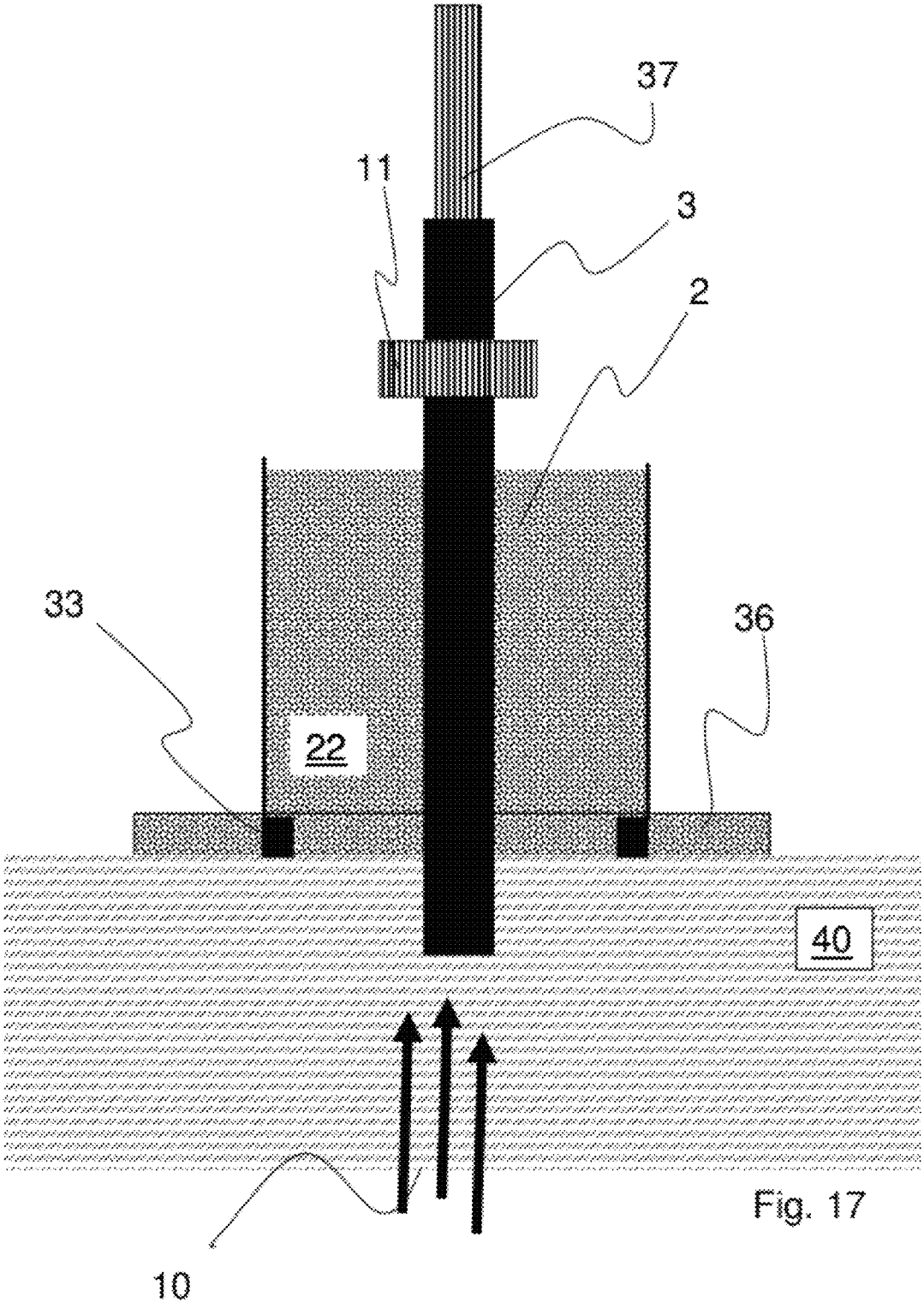

After concrete 35 that has been filled in first has hardened (here, for example, in a thickness of 2 m to 3 m concrete slabs 36 and/or approximately 20 m to 40 m diameter), triangular frame 22, for example, can be additionally filled up to the upper edge (see FIG. 17). This is for additional loading and stabilization of pipe 3 and/or riser pipe 37.

By using an underwater camera, the positioning above the borehole can be determined precisely and/or monitored. In the case of greater ocean currents it is recommended, however, that by using previously dropped anchors, in particular, with remote control windlass, a positioning of system 20 or 22 that is centimeter-precise is performed at the triangular frame.

In place of the triangular frame, a 2 m to 4 m high large-diameter pipe can also be used, for example, in particular with a diameter of approximately 20 m to 25 m and preferably with pipe 3 integrated in the center and/or preferably cylindrical riser pipe 37 can replace triangular frame 22. This complete economical and relatively easy device can be lowered with steel cables, for example by 1 or 2 working ships or with a catamaran.

As a result of this invention, a borehole can be securely sealed in a very easy and economical way. The devices and the method according to the invention are essentially usable for all ocean depths, for example from 7 m to 8,000 m and more, easy to use on very short notice and even economical. These types of devices and methods can be held available by all offshore-abutting countries in the event of catastrophes, in particular by oil companies themselves.

REFERENCE NUMBERS

1 device for sealing a borehole
2 hull or submersible body
3 pipe or suction pipe or funnel or riser pipe
4 cone
5 frame
6 hull
7 cable
8 carrier
9 foot
10 oil
11 valve
12 cement
13 pipeline
20 suction box
21 compartment
22 compartment of frame construction or frame
23 extraction opening
24 winch
25 guide pulley
26 anchor
27 eye
28 pump
29 carrier or carrier construction and/or fastening construction or frame for extraction pipe 3
30 suction box or unit for fastening or for adhering to the seafloor
31 fastening means
32 extraction pipe or unit for fastening or for adhering onto the seafloor
33 foot or stilt
34 supply line or pipe for concrete and/or cement
35 liquid concrete or hardenable mass
36 concrete slab
37 riser pipe
38 vertical rib
39 retaining device
40 seafloor

What is claimed is:

1. A method of sealing or securing an opening in a floor under a water surface from which a fluid gushes uncontrolled comprising the steps of:

placement of a ship having a hull and a vertical pipe extending through a bottom of the hull over the opening, loading the ship with a hardenable mass, submersing the ship above the opening in such a way, that the vertical pipe sits on the opening and the hull is aligned above the opening, distributing the hardenable mass around the vertical pipe allowing the hardenable mass to leak out of the hull whereby to fix the vertical pipe to the opening, sealing or securing the vertical pipe after the hardenable mass has hardened at least partially.

2. The method of claim 1, wherein cement is used as the hardenable mass, the cement reinforced with fibers or wires.

3. The method of claim 1, wherein the vertical pipe has a cone or collar.

4. The method of claim 1, wherein the hardenable mass is discharged via a frame that is at an opening at the bottom of the hull of said ship, which surrounds the vertical pipe.

5. The method of claim 1, wherein the vertical pipe is sealed by a throttling valve.

6. The method of claim 1, wherein the ship is lowered by cables.

7. The method of claim 1, wherein the ship is an old ship and comprising retrofitting the ship for implementing the method.

* * * * *